US011117783B2

(12) United States Patent
Lau

(10) Patent No.: US 11,117,783 B2
(45) **Date of Patent: *Sep. 14, 2021**

(54) SELF-PROPELLED ELEVATORS AND ELEVATOR BRAKE SYSTEMS

(71) Applicant: Kenny Wai Keung Lau, Lake Success, NY (US)

(72) Inventor: Kenny Wai Keung Lau, Lake Success, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/661,533

(22) Filed: Oct. 23, 2019

(65) Prior Publication Data

US 2020/0055701 A1 Feb. 20, 2020

Related U.S. Application Data

(63) Continuation of application No. 16/297,869, filed on Mar. 11, 2019, now Pat. No. 10,494,226, which is a (Continued)

(51) Int. Cl.

*B66B 5/18* (2006.01)
*B66B 5/00* (2006.01)

(Continued)

(52) U.S. Cl.

CPC ..... *B66B 5/18* (2013.01); *B66B 1/30* (2013.01); *B66B 1/32* (2013.01); *B66B 1/36* (2013.01); *B66B 1/40* (2013.01); *B66B 5/0018* (2013.01); *B66B 5/0031* (2013.01); *B66B 5/04* (2013.01); *B66B 5/06* (2013.01); *B66B 7/00* (2013.01);

(Continued)

(58) Field of Classification Search

CPC ..... B66B 5/18; B66B 9/06; B66B 11/0206; B66B 9/02; B66B 9/003; B66B 5/06; B66B 7/00; B66B 5/0031; B66B 11/0286; B66B 11/02; B66B 11/043; B66B 1/32; B66B 5/0018; B66B 5/04; B66B 1/36; B66B 1/30; B66B 1/40

See application file for complete search history.

(56) References Cited

U.S. PATENT DOCUMENTS 3,613,835 A * 10/1971 Vizzotto ..... B66B 1/28 187/288
3,658,155 A * 4/1972 Salter ..... B66B 9/00 198/798

(Continued)

FOREIGN PATENT DOCUMENTS

CN 1022399 C 10/1993
CN 2579858 Y 10/2003
CN 202296670 U 7/2012

OTHER PUBLICATIONS

Nov. 1, 2019 First Office Action, CN 201710070149.0.
Mar. 16, 2020 Office Action, TW 106104166.

*Primary Examiner* — Jeffrey Donels
(74) *Attorney, Agent, or Firm* — Law Offices of Albert Wai-Kit Chan, PLLC

(57) ABSTRACT

This invention is directed to a self-propelled elevator system having multiple motors or one motor, and methods for synchronizing said multiple motors. This invention is also directed to an elevator brake system to be used in said self-propelled elevator system or other types of elevators to increase their level of safety.

13 Claims, 16 Drawing Sheets

Related U.S. Application Data continuation of application No. 15/427,609, filed on Feb. 8, 2017, now Pat. No. 10,227,210.

(60) Provisional application No. 62/292,640, filed on Feb. 8, 2016.

(51) Int. Cl.

| | |
|---|---|
| ***B66B 5/06*** | (2006.01) |
| ***B66B 7/00*** | (2006.01) |
| ***B66B 9/00*** | (2006.01) |
| ***B66B 9/06*** | (2006.01) |
| ***B66B 1/30*** | (2006.01) |
| ***B66B 1/32*** | (2006.01) |
| ***B66B 1/36*** | (2006.01) |
| ***B66B 1/40*** | (2006.01) |
| ***B66B 5/04*** | (2006.01) |
| ***B66B 9/02*** | (2006.01) |
| ***B66B 11/02*** | (2006.01) |
| ***B66B 11/04*** | (2006.01) |

(52) U.S. Cl.

CPC ..... *B66B 9/003* (2013.01); *B66B 9/02* (2013.01); *B66B 9/06* (2013.01); *B66B 11/02* (2013.01); *B66B 11/0206* (2013.01); *B66B 11/0286* (2013.01); *B66B 11/043* (2013.01)

(56) References Cited

U.S. PATENT DOCUMENTS

| | | | | | |
|---|---|---|---|---|---|
| 4,051,923 | A * | 10/1977 | Blanchette | B66B 5/027 | 187/271 |
| 5,501,295 | A * | 3/1996 | Muller | B66B 9/00 | 187/406 |
| 5,518,087 | A * | 5/1996 | Hwang | B66B 5/18 | 187/374 |
| 5,669,469 | A * | 9/1997 | Ericson | B66B 11/0446 | 188/171 |
| 2002/0074194 | A1* | 6/2002 | Kimble | F16D 59/02 | 188/166 |
| 2011/0100761 | A1* | 5/2011 | Dudde | B66B 5/18 | 187/359 |
| 2013/0081907 | A1* | 4/2013 | Meierhans | B66B 5/20 | 187/359 |
| 2015/0129365 | A1* | 5/2015 | Olkkonen | F16D 65/0006 | 187/250 |
| 2016/0236904 | A1* | 8/2016 | Witczak | B66B 5/22 | |
| 2017/0313550 | A1* | 11/2017 | Vakkamaki | B66B 3/00 | |

* cited by examiner

Top View

Side View

SELF-PROPELLED ELEVATORS AND ELEVATOR BRAKE SYSTEMS

FIELD OF THE INVENTION

This invention relates to elevators, particularly self-propelled elevators, and elevator brake systems.

BACKGROUND OF THE INVENTION

Typically there is only one elevator per elevator shaft. In an attempt to save space and improve waiting time, some cableless elevators have been described, such as in U.S. Pat. Nos. 5,501,295, 4,051,923 and 3,658,155. These elevators can travel vertically and horizontally, but are not designed to travel along a curved track or a track that is neither vertical nor horizontal because the elevator cab will not stay in a vertical position.

In current elevator systems, such as traction or machine room-less elevators, hoist cables above an elevator cab are used for pulling the cab up or down in a elevator shaft. The hoist cables are firmly connected to the elevator cab at one end and counter weights at the other. Machine sheave is turning to bring the elevator up and down. The disadvantages for these elevators are obvious, and include the requirement for a machine room or space in the shaft to locate the machineries, maintenance of the cables due to wear and tear, and tripping hazard due to re-leveling as a result of cables stretching or weight changing when passengers enter or exit the elevator. The design of such elevators is limited, and typically involves up and down movement of a single elevator cab in a straight vertical elevator shaft. Furthermore, these elevators cannot fit into elevator shaft that are built to be used for hydraulic elevators because of the space limitation.

For hydraulic elevators, they suffer from the disadvantages of slow speed, noisy operation and a relatively low height limit. The hydraulic elevators may also pose environmental hazard when there is leakage of the hydraulic fluid. Typically, the elevator cab is connected directly or indirectly through hoist cables with a hydraulic piston. When the piston goes up and down, so does the elevator. There are currently some devices to achieve ACO (ascending cab over speed protection) and UCM (unintended cab movement protection) protection like electric stop valve and piston brake. An electric stop valve stops the pump from providing pressure so as to stop the elevator. A piston brake clamps on the piston to stop the elevator.

Current options for stopping the elevator cabs during an emergency includes:

1) Rope gripper, which clamps on the hoist cables to stop the elevator.
2) Sheave brake, which clamps on the traction sheave to stop the elevator.
3) Emergency Brake on motor, which clamps on the motor shaft or pulley to stop the elevator.

Most of the current solutions will work on new elevator systems but may be difficult to be adapted to older and existing elevators. However, all the methods mentioned above only indirectly stop the elevator cab, and they suffer from substantial shortcomings. For example, if the hoist cable breaks, the elevator will fall, and all of the above-mentioned emergency brake systems will be useless. Also, they all require the elevator controller to have circuitries and programs in order for them to function.

There is significant need for better designed elevators and ways to overcome the problems with current traction, machine room-less and hydraulic elevators. The present invention serves to address these problems.

SUMMARY OF THE INVENTION

The present invention provides a self-propelled elevator system comprising an elevator cab, two parallel guide rails, one or more vehicle propulsion systems, one or more brake systems, and one or more control modules. The present invention allows the elevator cab to maintain a vertical position even when it travels along a curved track or a track that is neither vertical nor horizontal. Also, by employing proximity sensors and programming, a safe distance between multiple elevator cabs in the same elevator shaft can be kept, and the cabs will slow down and stop when approaching a barrier such as a terminal landing or wall.

The present invention also provides an elevator brake system for said self-propelled elevator or other elevator systems, e.g. traction or hydraulic elevators, to increase their level of safety. Said brake system comprises one or more control modules, two or more electromechanical brakes, one or more leveling sensors and one or more speed sensors. Besides normal brake function, the brake system also monitors the elevator cab speed and, in the event of excessive speed or unintended movement of the elevator cab, will safely stop the elevator cab.

The present invention further provides a method for synchronizing and controlling multiple motors in a multi-motor elevator system, comprising the use of vector drive, and CPU system to accurately and safely operate an elevator cab.

DETAILED DESCRIPTION OF THE INVENTION

To overcome the deficiencies of existing elevator systems, the present invention provides a self-propelled elevator system having at least one motor, a method for synchronizing and controlling said multiple motors, and an elevator brake system that can be used not only in said self-propelled elevator system, but also in other types of elevators to increase the level of safety.

The self-propelled elevator of this invention has smaller elevator shaft and overhead space requirements than traction or machine room-less elevators, produces less noise, and does not need any machine room, hoist and governor cables, sheaves, governor, overheads, counterweights or rope gripper. Furthermore, the elevator of the present invention requires less installation time, does not need a temporary platform during installation, and requires no outside hoist when constructing a new building.

Advantages of the self-propelled elevator of this invention include:

1) Since the motors are directly driving the elevator cab, there are less components which hence will be subject to much less wear and tear; better motor control and ride quality are also expected;
2) Since there are no hoist cables, routine maintenance for such cables is unnecessary;
3) No counterweights are required;
4) Since there are no cables, there will not be restriction to the directions in which the elevator cab can go, like going up, down, diagonally or horizontally;
5) Since the elevator does not require cables, multiple elevators can operate in the same elevator shaft at the same time, increasing efficiency and reducing the time waiting for an elevator.
6) The elevator not using a hydraulic system can move at a higher speed;
7) Since no hydraulic oil is required, there will be no oil leak, no replacement of oil seals or smell of hydraulic oil.

In one embodiment, the present invention provides an elevator system comprising an elevator main frame, an elevator cab, two parallel guide rails, one or more vehicle propulsion systems, and one or more brake systems.

Figure 1A:
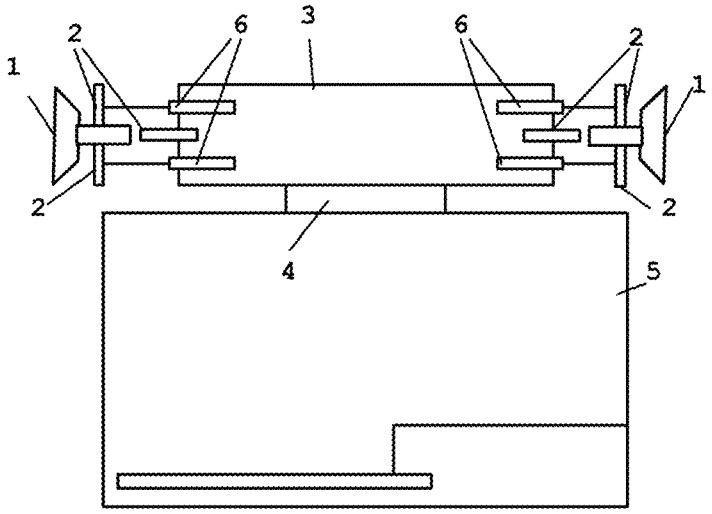
FIG. 1A is the top view of an elevator system of this invention, comprising an elevator cab (5), an elevator main frame (3), an attachment assembly (4), two parallel guide rails (1), one or more vehicle propulsion systems, each comprising one or more motors (6) and a roller assembly (2), and one or more brake systems at the bottom of said elevator main frame.
Figure 1B:
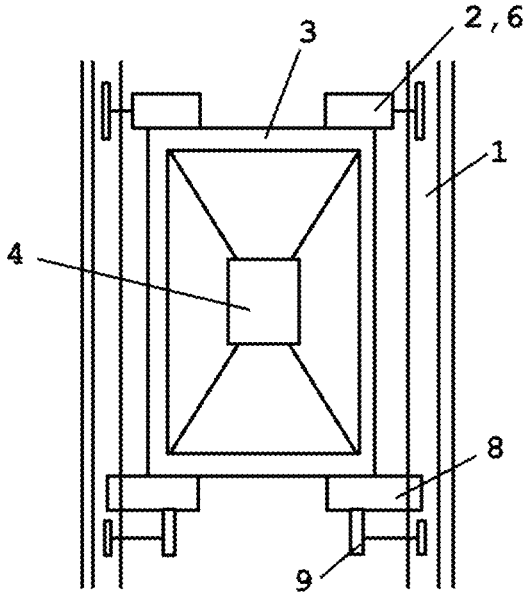
FIG. 1B shows an embodiment of how an elevator main frame (elevator cab not shown) with brake systems (8) and roller guides (9) is mounted between two parallel guide rails (1).
Figure 1C:
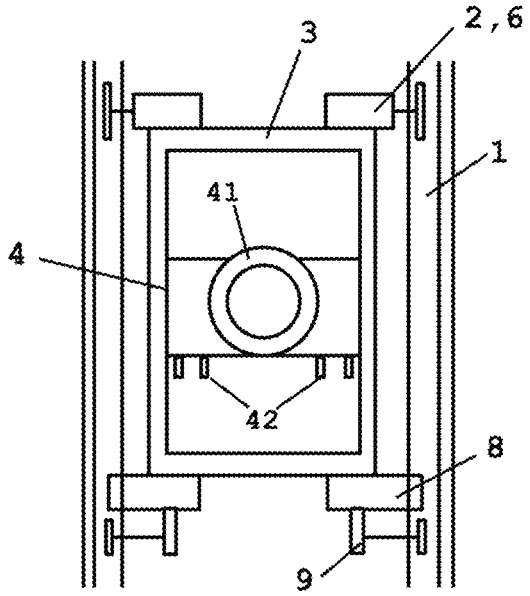
FIG. 1C shows an elevator of this invention, whereby an elevator main frame (3) (elevator cab not shown) with brake systems (8) and roller guides (9) is mounted between two parallel guide rails (1), said elevator main frame comprising an attachment assembly (4) having an adaptor shaft (41) and two hydraulic piston attachment brackets (42).
Figure 1D:
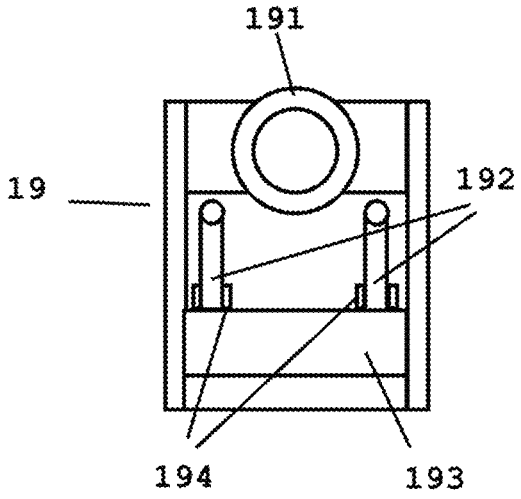
FIG. 1D shows an elevator cab frame (19), comprising a main bearing (191) having an internal diameter that matches the diameter of the adaptor shaft on the elevator main frame, a platform (193) and two hydraulic pistons (192), each of which is attached to the elevator cab frame via an attachment bracket (194) at one end, and to be attached to an attachment bracket (42) on the elevator main frame at the other end.
Figure 1E:
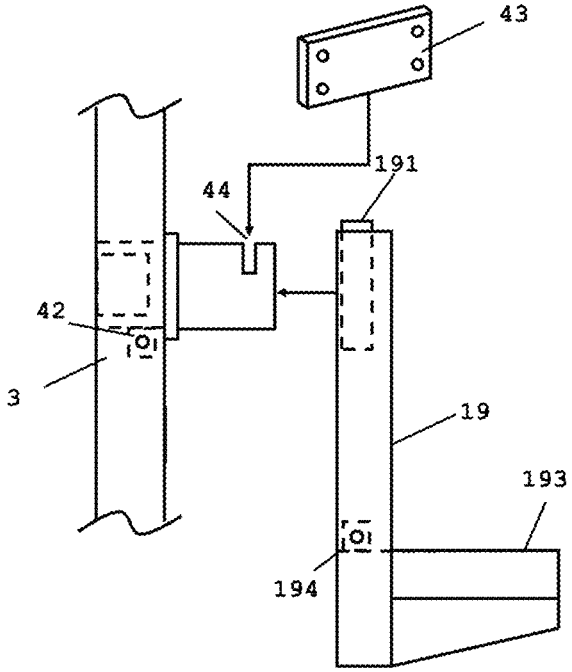
FIG. 1E shows how an elevator cab frame (19) is to be attached to an elevator main frame (3) by sliding a main bearing (191) of the elevator cab frame over an adaptor shaft (41) of the elevator main frame, followed by inserting a security plate (43) into a slot (44) in the adaptor shaft to firmly secure the attachment.
Figure 1F:
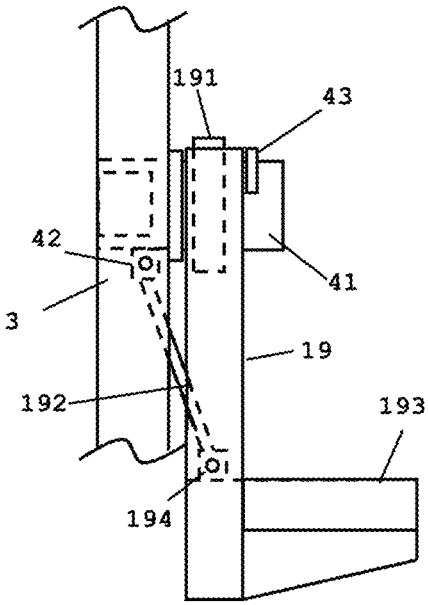
FIG. 1F shows an elevator cab frame firmly attached to an elevator main frame after a security plate (43) is installed, wherein the two frames are also held together via a hydraulic piston on each side of the frames, wherein one end of each piston is attached to the elevator main frame and the other end is attached to the elevator cab frame via an attachment bracket (42 and 194).
Figure 3A:
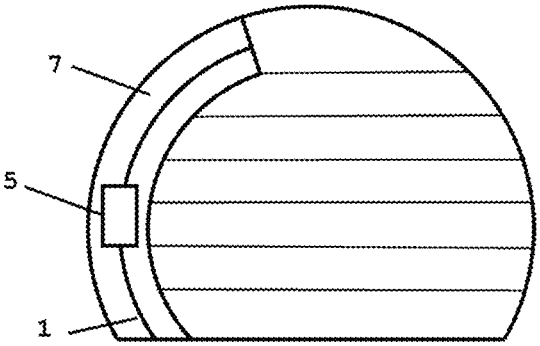
FIG. 3A is a diagrammatic representation of an elevator cab of this invention operating in a curved elevator shaft (7) of a multi-story building.
Figure 3B:
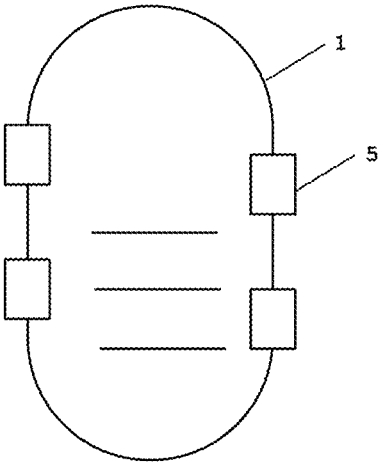
FIG. 3B is a diagrammatic representation of a plurality of elevator cabs of this invention operating in a looped elevator shaft.
Figure 3C:
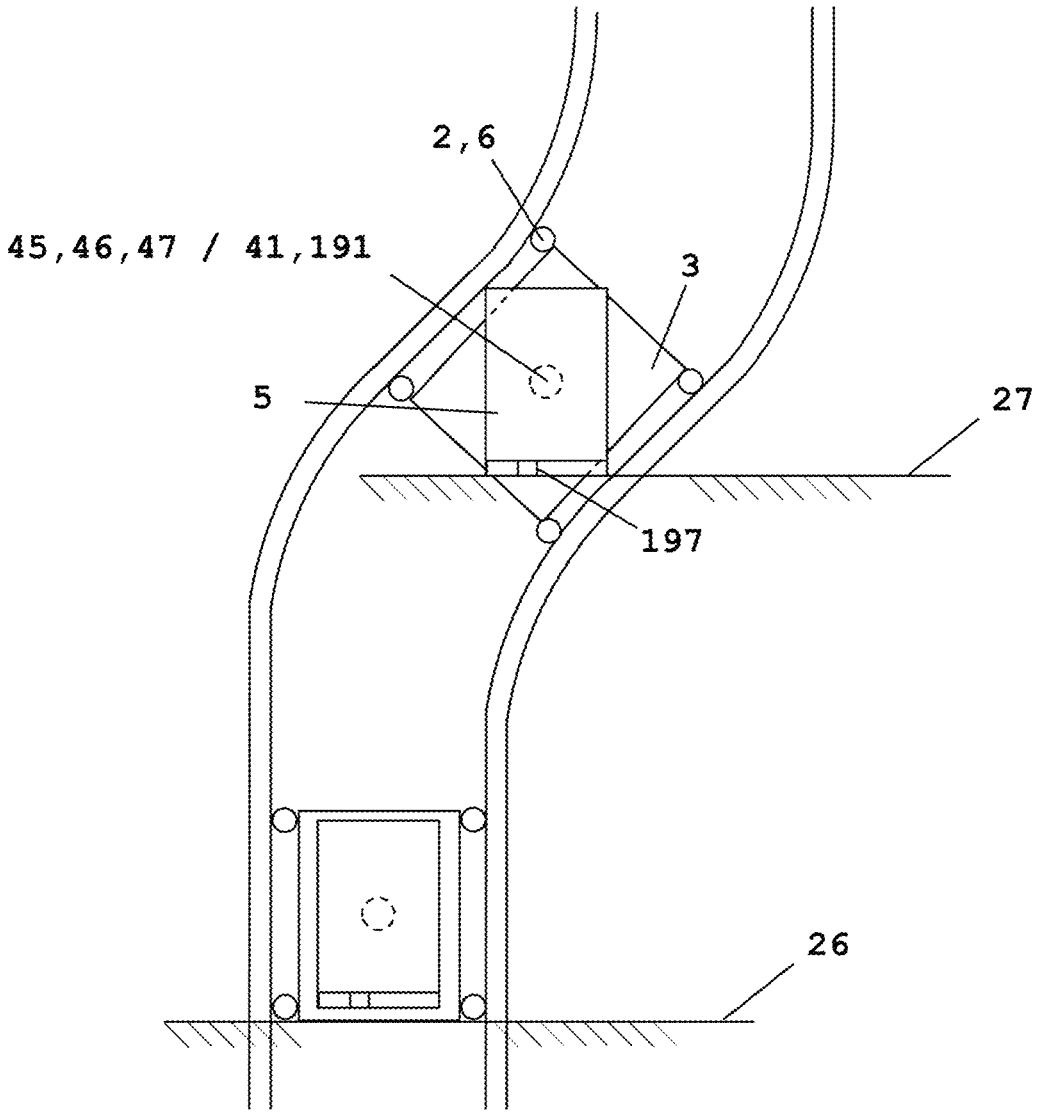
FIG. 3C illustrates how an elevator cab of this invention stays vertical when travelling in a curved hoistway between two landings (26, 27).

As shown in FIG. 1A, an elevator cab (5) is securely attached to an elevator main frame (3) via an attachment assembly (4) which can serve as a pivot so that the elevator cab can stay in a vertical position even when the elevator main frame is not. This is important when the elevator cab travels in a curved elevator shaft as illustrated in FIGS. 3A and 3B.

In one embodiment, one or more vehicle propulsion systems are installed on top of an elevator main frame, each comprising one or more motors and a roller assembly. Said roller assembly comprises a set of two or more drive wheels or rollers. In another embodiment, each roller assembly comprises a set of three drive wheels or rollers. In a further embodiment, there is one vehicle propulsion system installed at each top corner of the elevator main frame. Each set of drive wheels or rollers is powered by said one or more motors to ride along a guide rail on either side of the elevator main frame. Alternatively, said vehicle propulsion systems are installed on top of the elevator cab, or at other locations of the elevator cab, including the sides and bottom. In these cases, an elevator main frame and an attachment assembly can be installed at the center of the elevator cab (5).

In one embodiment, the motors of the vehicle propulsion systems are synchronized.

In one embodiment, said drive wheels or rollers are made of a durable elastic material, or rubber reinforced with steel wires to produce sufficient traction between the drive wheels or rollers and the guide rails. In another embodiment, the drive wheels are gears that are complementary to some teeth on the guide rails.

In one embodiment, the motors of the vehicle propulsion systems are controlled by one or more control modules installed on the elevator cab or elevator main frame. The control modules may receive signals from sensors that may be installed in the one or more brake systems.

In one embodiment, the one or more control modules are installed on the elevator main frame, or on top of the elevator cab, or at any other locations on the elevator cab including the sides and bottom. In another embodiment, the one or more control modules can communicate with hand-held devices located in the elevator cab or away from it. In one embodiment, the hand-held devices are used during maintenance and testing, in the elevator cab or at hall stations. Said devices can activate the control modules to perform any functions the control modules are capable of, such as stopping the elevator cab at a desired floor for inspection.

The communications between the hand-held devices and the control modules on the elevator cab may be wireless, or via cables.

In one embodiment, each of the control modules is designated with specific functions. In another embodiment, a master control module will coordinate the signals from all the control modules in the elevator system. In a further embodiment, there is a hierarchy among the control modules.

Figure 4A:
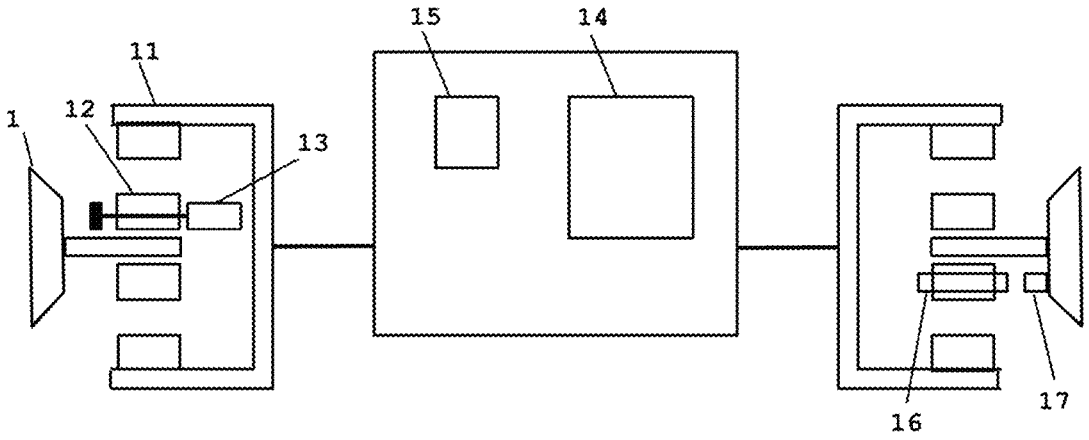
FIG. 4A shows an elevator brake system of this invention, comprising two brake housings (11) electrically connected to a brake control box. Each of the brake housing contains a speed sensor (13), a leveling sensor (16), and an electromechanical brake comprising brake shoes (12) and coil springs (not shown, between each set of two adjacent brake shoes). Said box contains a control module (14) and a contactor (15). Each of the housing is configured to allow a guide rail to run between two brake shoes inside the housing as shown. The leveling sensor (16) will detect the signals from a leveling magnet (17) on the rail so that the elevator cab will stop in such a way that the cab floor will be aligned with the landing platform.
Figure 4B:
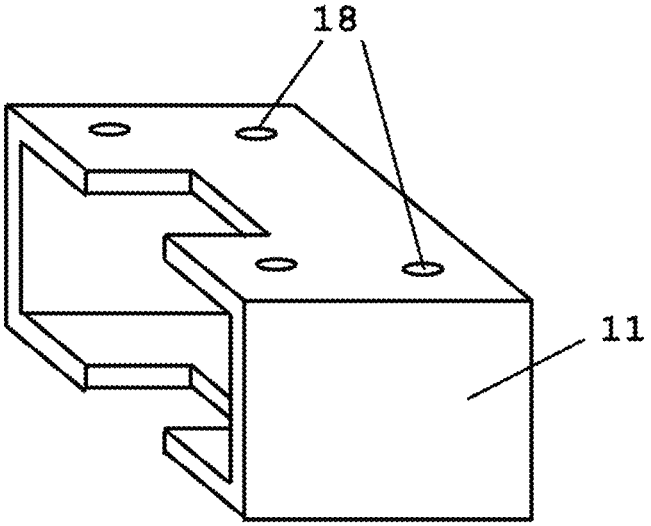
FIG. 4B is a perspective view of the brake housing (11) of one embodiment of the brake system of the present invention with mounting holes (18).
Figure 4C:
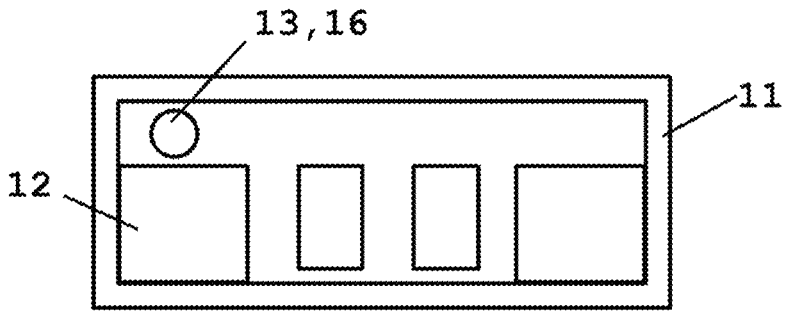
FIG. 4C is the front view of the brake housing (11), showing the leveling sensor (16)/speed sensor (13) and brake shoes (12) (coil springs between the brake shoes not shown).
Figure 4D:
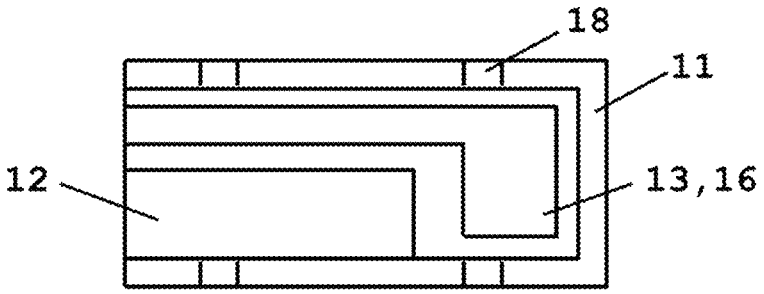
FIG. 4D is a cross-sectional view as seen from the side of the brake housing (11), showing a brake shoe (12), leveling sensor (16)/speed sensor (13), and mounting holes (18).
Figure 4E:
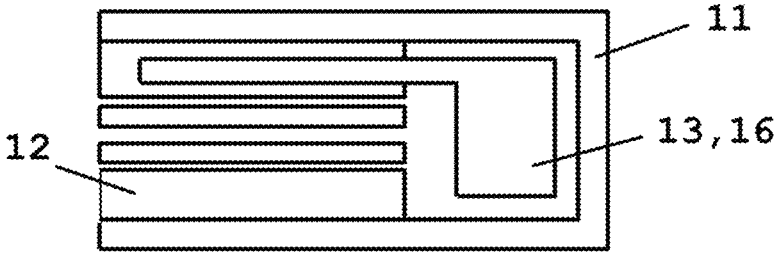
FIG. 4E is a cross-sectional view as seen from the top of the brake housing (11), showing the brake shoes (12) and leveling sensor (16)/speed sensor (13).
Figure 4F:
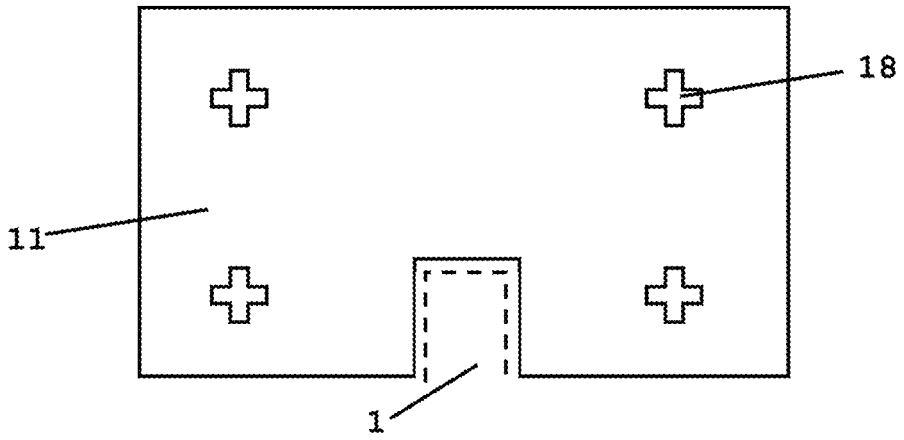
FIG. 4F shows the top and side view of an elevator brake system of this invention where coil springs (121) are used for pushing the brake shoes (12) onto the guide rail (1).
Figure 4F:
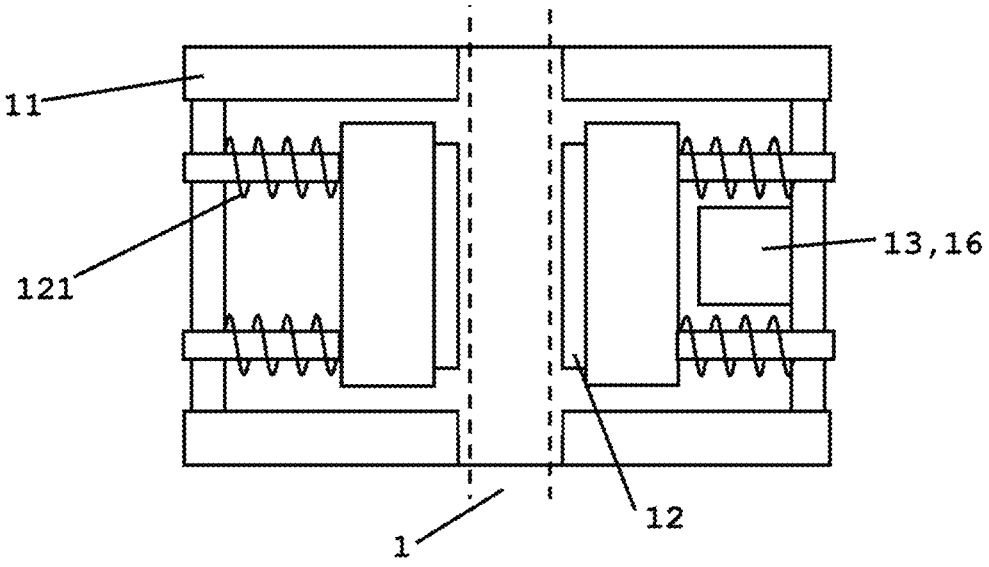

In one embodiment, the elevator brake system of the present invention comprises two brake housings (11) electrically connected to a brake control box (10), which contains a control module (14) and a contactor (15) (see FIG. 4A). In another embodiment, the two brake housings are installed at the two bottom corners of an elevator main frame, or on opposite sides of the bottom of an elevator cab. Each brake housing contains a speed sensor (13), a leveling sensor (16), and an electromechanical brake comprising brake shoes (12), electromagnets and coil springs (not shown). In one embodiment, there are two pairs of brake shoes aligned in a straight line inside said housing, each of said brake shoes is attached to an end of a coil spring. The housing is configured to allow a guide rail to be located between two brake shoes when the elevator travels along the guide rail. When the two electromagnets are not supplied with electricity, the coil springs will relax, pushing the two brake shoes against the guide rail. When the brake shoes on either side of an elevator cab work simultaneously in this manner, sufficient friction will be created between the guide rails and brake shoes to slow down and stop a fully loaded elevator cab, or hold it in position. More than one brake systems may be installed on an elevator cab to meet the weight requirement, or as backup. When the two electromagnets are supplied with electricity, the coil springs will contract, thereby releasing the two brake shoes from the guide rail to allow the elevator cab to move. A leveling sensor (16) will detect the signals from a leveling magnet (17) on the rail so that the elevator cab will stop and maintain a level position.

Figure 5:
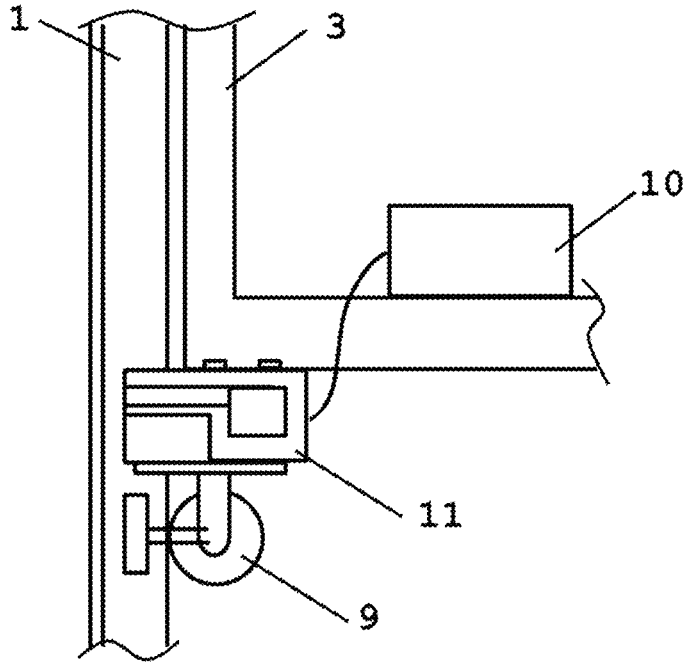
FIG. 5 shows part of a brake system of the present invention, wherein a brake housing (11) is installed at a bottom corner of an elevator main frame (3), wherein the brake housing is electrically connected to a control box (10), and is attached to a roller guide (9) which is engaged with a guide rail (1).

In one embodiment, the brake housing is installed at the bottom of the elevator main frame while the brake control box is mounted to other parts of the elevator main frame (See FIG. 5).

In one embodiment, the amount of electricity supplied to the electromagnets is determined by the control module based on input from one or more sensors. Said one or more sensors are selected from speed sensors, force sensors, temperature sensors and position sensors.

The speed sensor can detect excessive speed or unintended movement of the elevator cab, and sends signals to the control module, which then activates the brake systems to safely stop the elevator cab. In one embodiment, said control module comprises one or more microprocessors (MPU). In a further embodiment, if there is more than one brake systems on an elevator cab, all brakes will be activated when any one of the brake systems receives signals indicating an excessive speed or unintended movement of the elevator cab. The brake system of the present invention can also be installed and/or retrofitted in other elevator systems, e.g. traction or hydraulic elevators, to increase their level of safety.

In one embodiment, when the elevator cab is moving over a pre-determined speed, the control module of the brake system will detect a signal from a speed sensor and cut off the electricity supply to the electromagnets, causing the elevator cab to safely come to a stop. In another embodiment, the control module can compare a signal from the speed sensor against the intended status of the elevator cab, e.g. stopping at a particular floor. If there is unintended movement, the control module will cut off electricity supply to the electromagnets to prevent the elevator from further movement.

During normal run, the brakes will stay open to permit the elevator cab to go up and down the guide rails.

For an elevator with hoist cables, when passengers go in or out of the elevator cab, the hoist cables may be stretched and cause the elevator floor to move slightly above or below the building floor. By adding this brake system, when the elevator stops, the cab is kept in position by brakes instead of indirectly through the machine and cables. As such, the elevator cab will stay at the same level even when passengers go in or out of the elevator cab.

Figure 7:
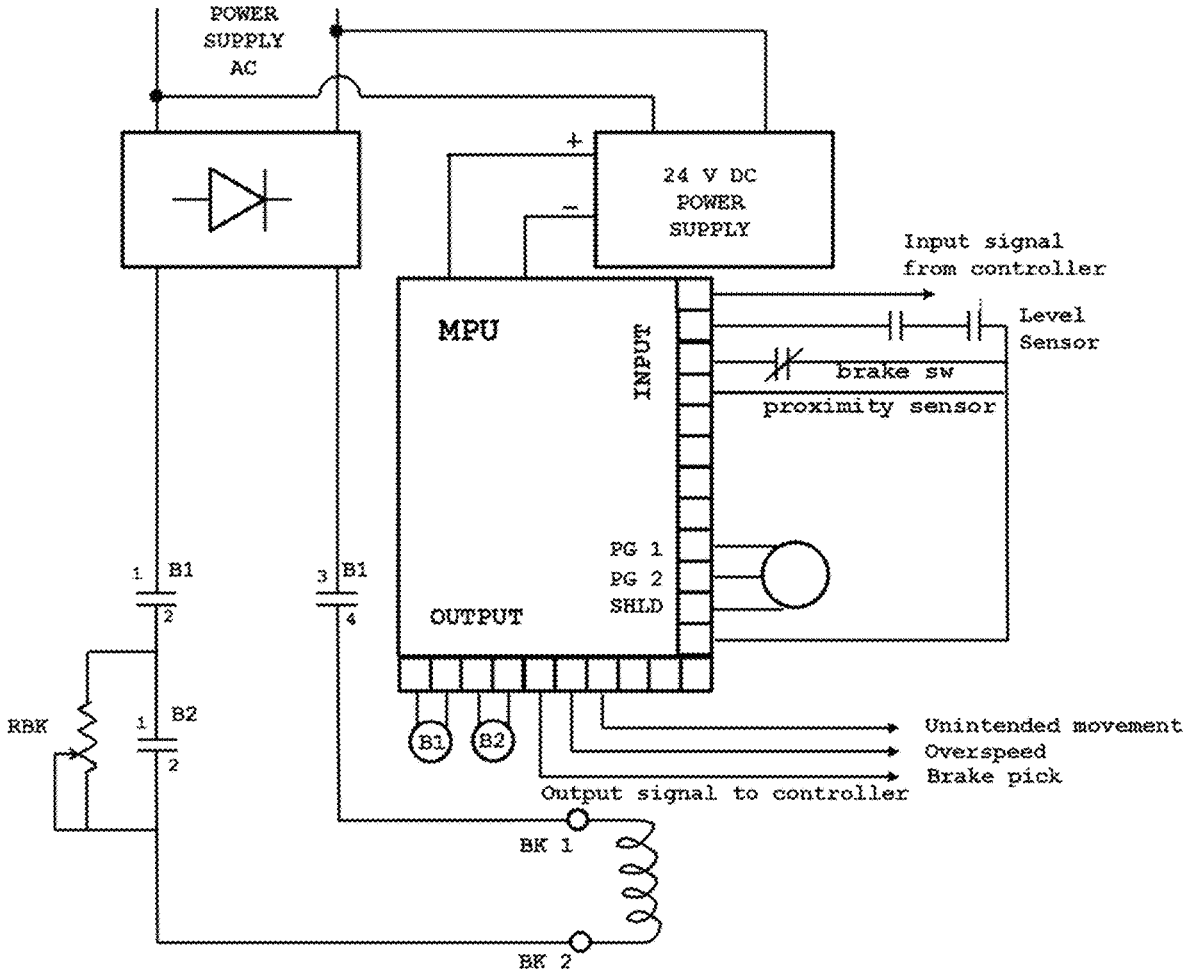
FIG. 7 is a schematic diagram of an electronic circuitry used in a brake system of the present invention.
Figure 8A:
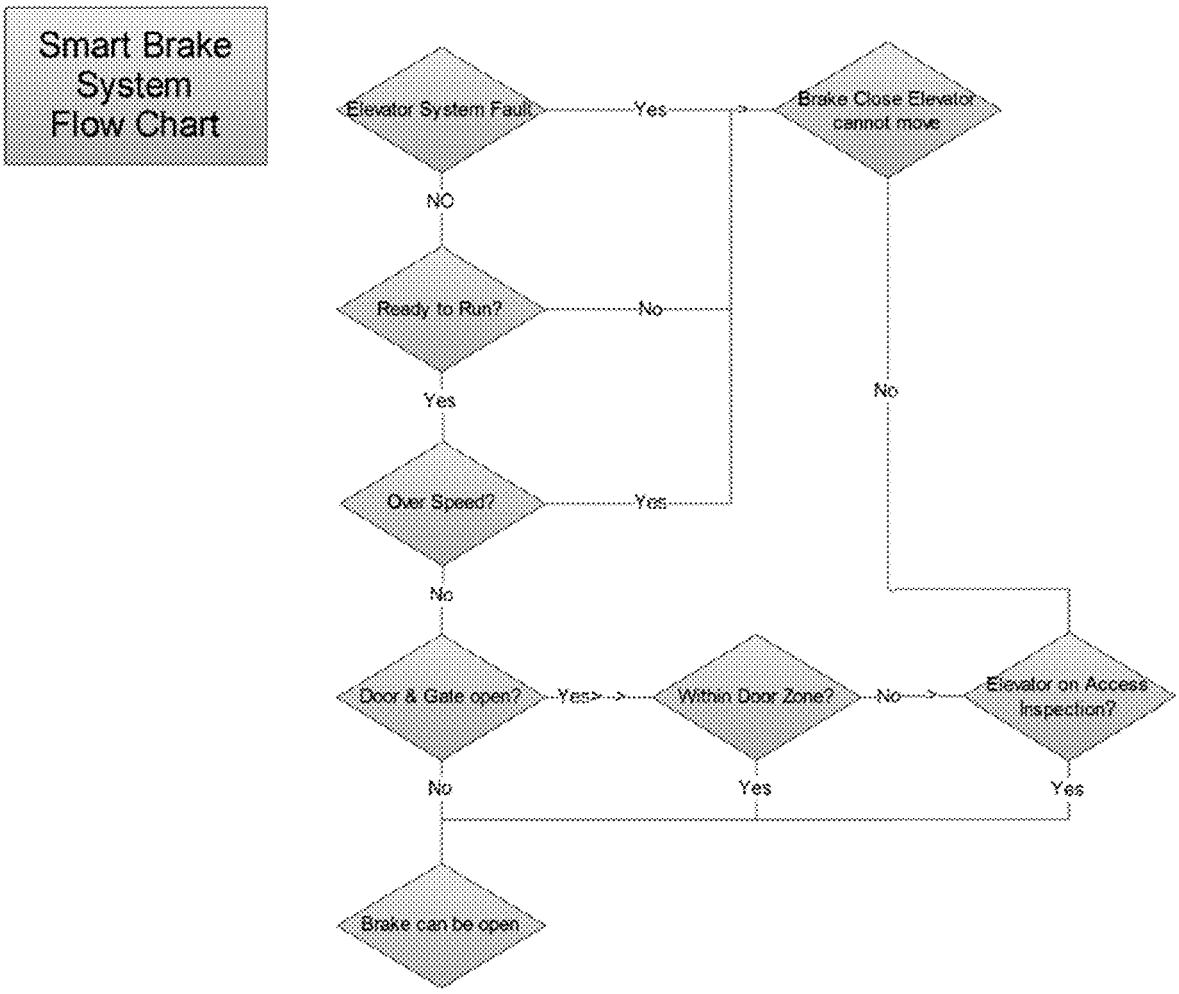
FIG. 8A shows an algorithm for controlling the brake system of the present invention.
Figure 8B:
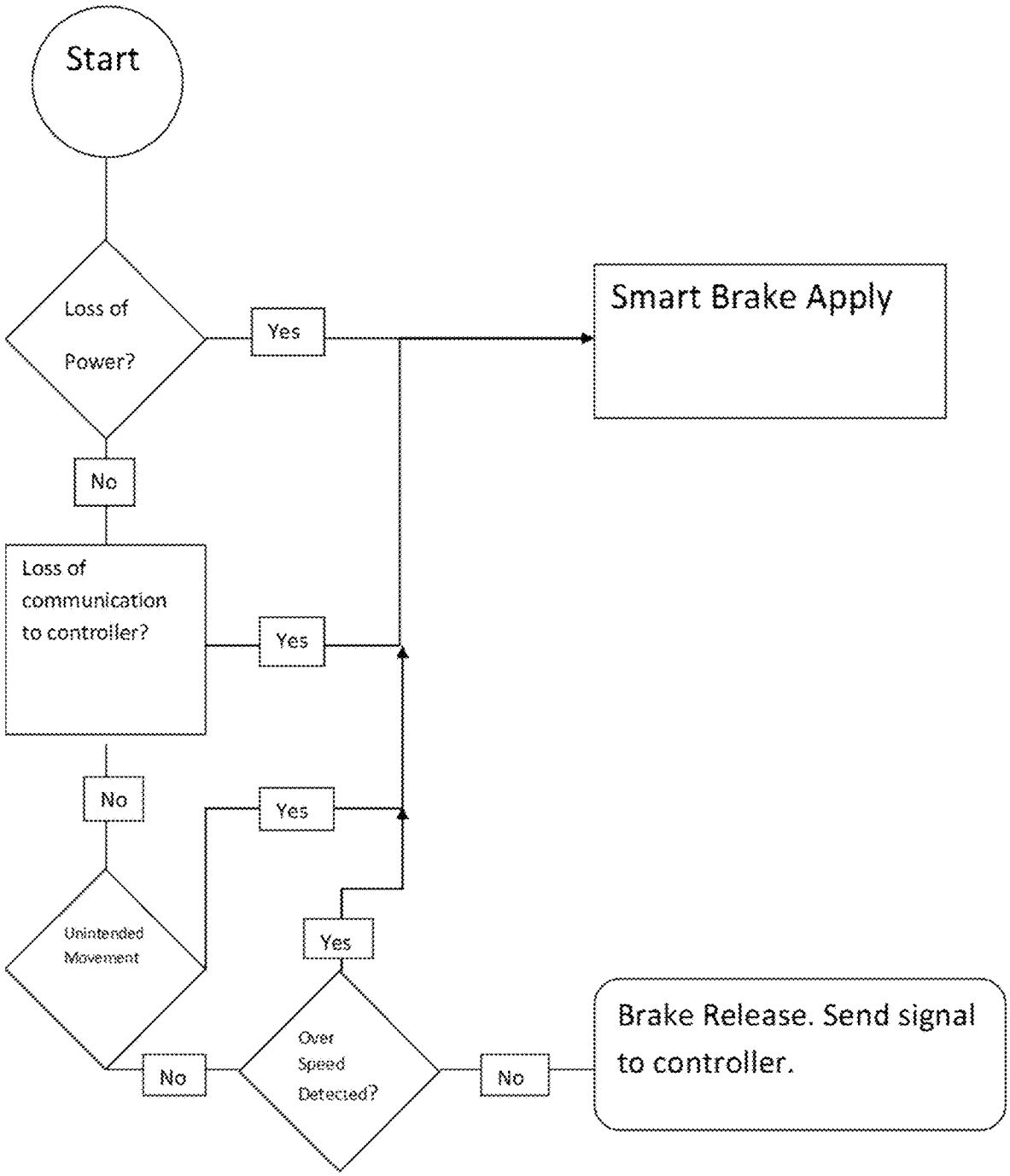
FIG. 8B shows another algorithm for controlling the brake system of the present invention.
Figure 9:
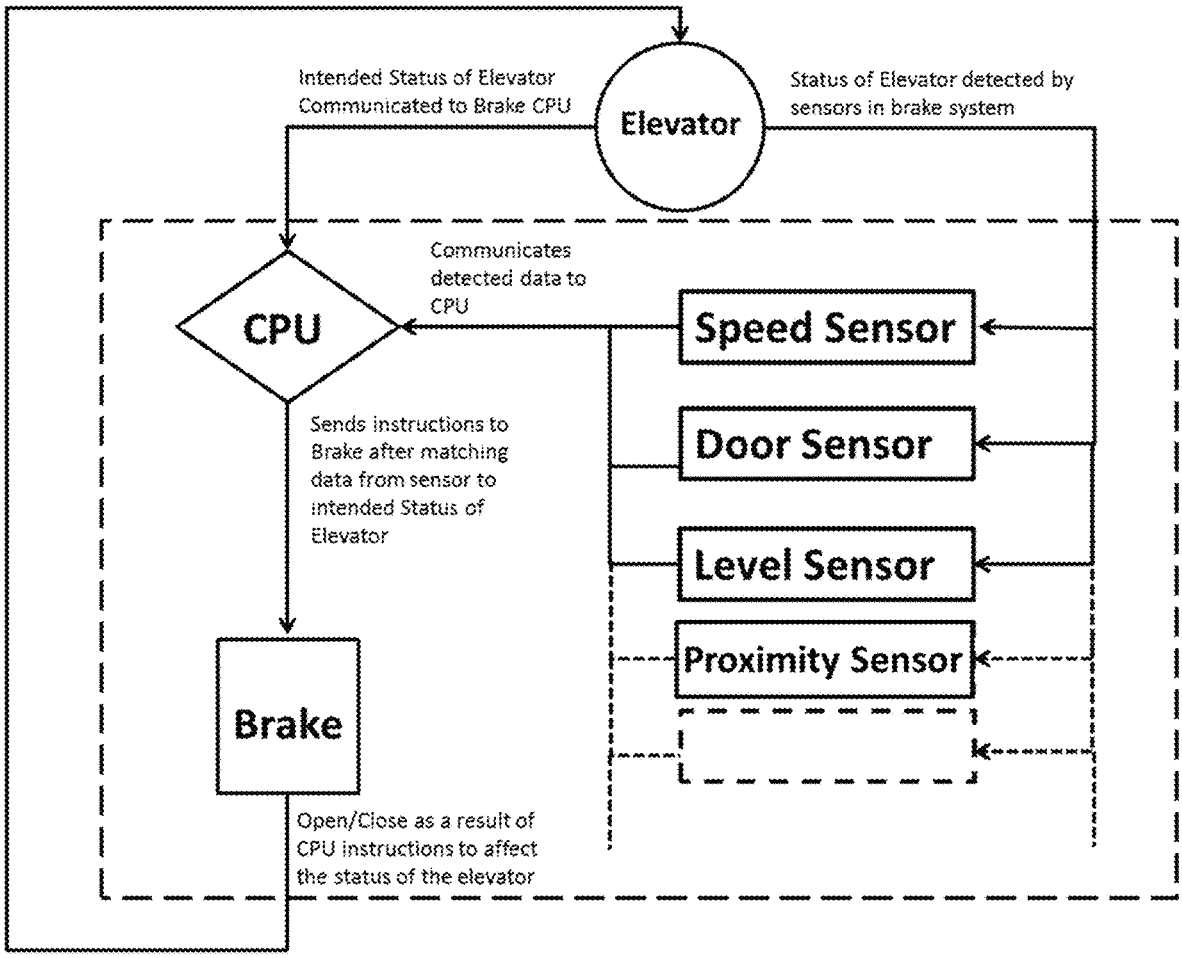
FIG. 9 illustrates the interaction between a control module of the present elevator and different sensors.

In one embodiment, an electronic circuitry for controlling the brake system based on signals from the speed sensor and leveling sensor is shown in FIG. 7.

Figure 6A:
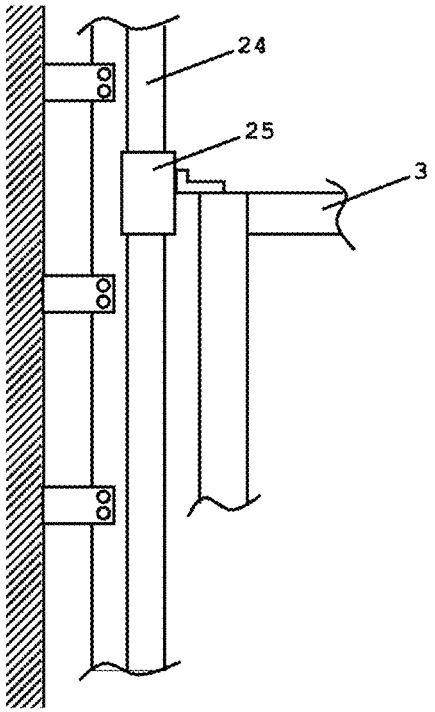
FIG. 6A shows a power supply strip (24) and a power receiver (25) connected to an elevator main frame (3) of this invention.
Figure 6B:
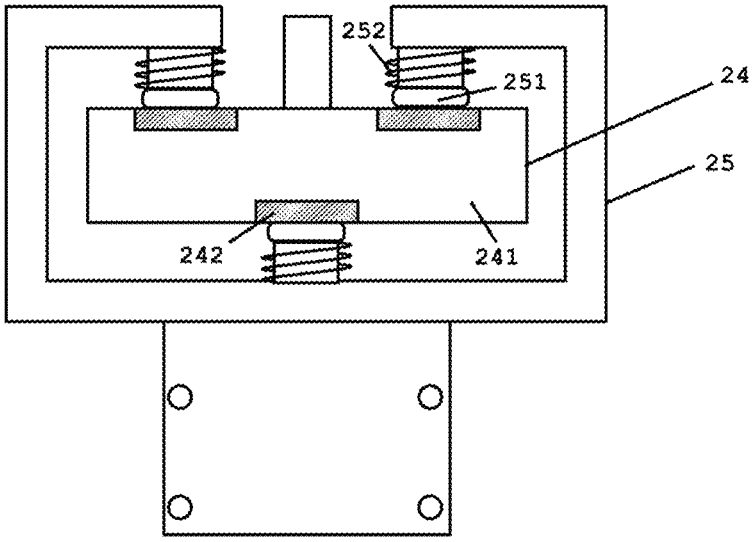
FIG. 6B is a cross-sectional view of a power receiver (25) connected to a power supply strip (24); the power supply strip comprises an insulator (241) and one or more conductive strips (242), which can be made of copper or other conductive materials; the power receiver (25) encapsulates a portion of the power supply strip and has conductive rollers (251) pressing against the one or more conductive strips (242) via springs (252).

In one embodiment, one or more pantograph-like devices on the elevator cab obtain power from a power source. In another embodiment, power cables are connected to the elevator cab. In a further embodiment, one or more additional rails are installed in the elevator shaft wherein one end of said additional rails will be connected to a power source. In another embodiment, the elevator cab is equipped with a conducting device for obtaining power from said additional rails. In one embodiment, a power supply strip (24) runs along the guide rail (1); the power supply strip is connected to a power source and comprises an insulator (241) and one or more conductive strips (242) as shown in FIG. 6B. In another embodiment, a power receiver (25) on the elevator main frame obtains power from the power supply strip (24); the power receiver (25) encapsulates the power supply strip and has conductive rollers (251) pressing against the one or more conductive strips (242) via springs (252) as shown in FIG. 6B so that the conductive rollers (251) will remain in contact with the conductive strips (242) when the elevator moves along the guide rail.

In one embodiment, one or more position sensors are installed around the door of the elevator cab to ensure that the elevator cab stops at the correct position to prevent tripping hazard. In another embodiment, the signals from the position sensors are sent to the control modules of the vehicle propulsion systems. In a further embodiment, one or more leveling magnets are installed on the guide rails such that the leveling sensors on the brake systems can detect the correct position for stopping the elevator cab.

In one embodiment, there are more than one elevator cabs traveling in an elevator shaft along a pair of guide rails. Said elevator cabs can travel in the same direction or opposite directions. In a further embodiment, one or more control modules control the speed and direction of the elevator cabs to keep them at a safe distance from one another. In one embodiment, when a first elevator cab leaves a station, a second elevator cab can move into said station to pick up passengers, and then move in the same direction as the first cab or otherwise. In another embodiment, when there is less demand for elevator cabs, some of the elevator cabs can be parked at the top or bottom of the elevator shaft.

In one embodiment, the elevator shaft in a high-rise building can be divided into smaller segments, each covering 10 to 20 stories, So that an elevator cab can move from one segment to the next. This design will allow the elevator cab to be placed at a location convenient and safe for repair.

In one embodiment, the elevator shaft to be used with the elevator system of this invention is not a straight elevator shaft. As shown in FIGS. 3A and 3B, an elevator cab can follow the path along a set of curved guide rails to move up or down a curved elevator shaft in a building. In another embodiment, as shown in FIG. 3B, the guide rails form a loop, and more than one elevator cabs can move in the same direction or in opposite directions along the guide rails.

In one embodiment, when the elevator shaft is curved or in other configurations (e.g. FIGS. 3A and 3B), the elevator cab can stay upright even when the elevator main frame (3) needs to change its direction of travel to conform to the shape of the elevator shaft, because the elevator main frame (3) has an adaptor shaft (41) attached to a main bearing (191) on an elevator cab frame (19) which is connected to an elevator platform (193) or the elevator cab (FIGS. 1C-1H). In one embodiment, there are two hydraulic pistons (192) on each side of the main bearing (191) on the elevator cab frame (19) to stabilize movement of the elevator cab/platform when the elevator main frame (3) and the elevator cab frame (19) rotate relative to each other around the main bearing (191) to keep the elevator cab upright. In another embodiment, the elevator cab frame (19) further comprises an elevator platform (193) of sufficient weight to keep the center of gravity of the elevator cab frame (19) below the main bearing (191) so that the elevator cab frame (19) will be kept upright even when the elevator main frame (3) moves through a curved elevator shaft.

Figure 1G:
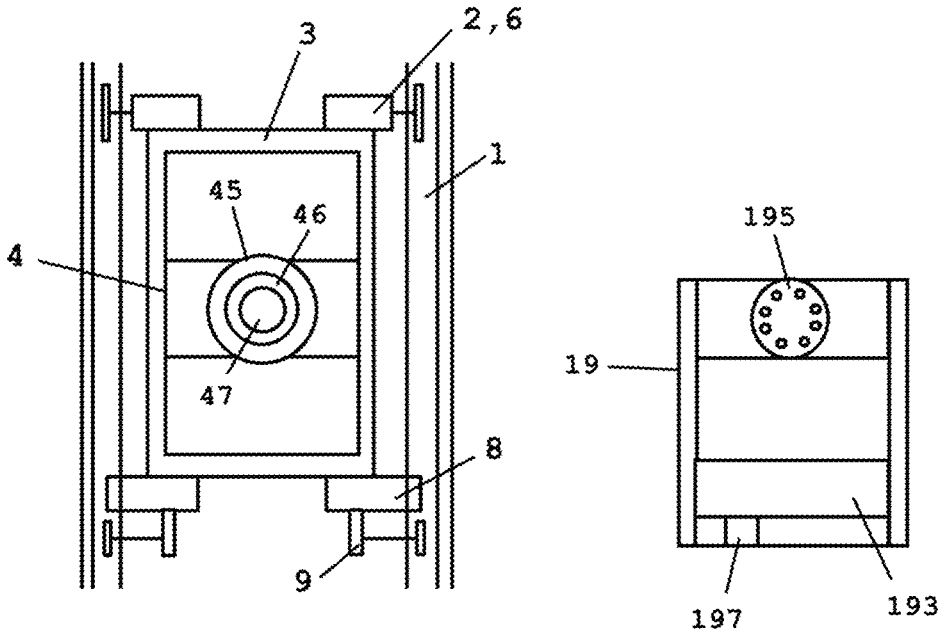
FIG. 1G shows an elevator main frame (3) having an alignment motor (45), a clutch (46) and a motor shaft with coupling (47), and an elevator cab frame (19) having a motor adaptor plate (195) with machine bolt holes to be attached to the motor shaft with coupling (47) of the elevator main frame.
Figure 1H:
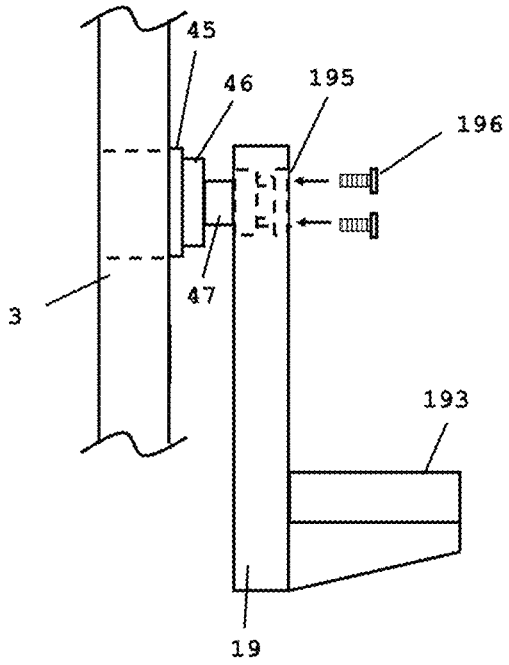
FIG. 1H shows how the elevator cab frame of FIG. 1G is to be firmly attached to the elevator main frame (3) with machine bolts (196).

FIGS. 1G and 1H show another embodiment of this invention. An alignment motor (45) and a clutch (46) are installed on an elevator main frame (3) while a gyro sensor (197) is installed onto the elevator cab frame to continuously monitor the orientation of the elevator cab. The elevator cab frame (19) has a motor adaptor plate (195) to be attached to a motor shaft with coupling (47) on the elevator main frame (3) by machine bolts (196). When the gyro sensor (197) detects that the elevator cab frame (19) is moving out of the vertical position, signal will be sent to the elevator controller module so that the clutch (46) will be released and the alignment motor (45) will rotate in a direction that will return the elevator cab to the vertical position. Once the rotation is complete, the clutch (46) will be re-engaged and lock the elevator cab in position.

The present invention further provides a method for synchronizing and controlling the motors in a multi-motor elevator system. In one embodiment, said method comprises the use of a single vector drive and CPU system to improve the precise operation, comfort and safety level of the elevator.

In one embodiment, each motor has a tachometer and/or encoder which measures the speed of the motor and sends the information to one or more control modules, which in turn determine the reference motor requiring the highest power to run at the same speed as the other motors. Said one or more control modules then adjust the power provided to each of the motors so that the reading from the tachometer of each motor would be identical; i.e. the motors are synchronized. In another embodiment, the different power requirements for each motor to run at the same speed are pre-determined so that said one or more control modules do not need to constantly monitor the speed of the motors. In a further embodiment, the speeds of the motors are constantly monitored by said one or more control modules. In another embodiment, the motors are synchronized in a manner that would allow an elevator cab to safely ride through a curve.

Figure 1I:
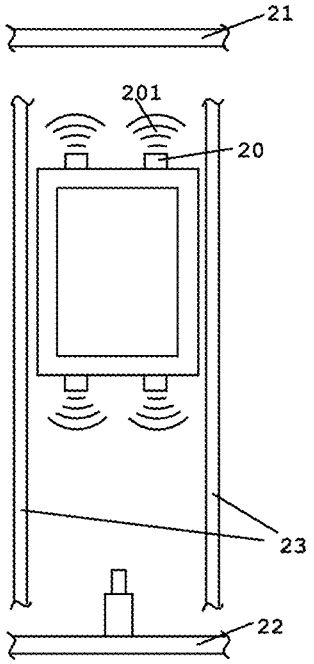
FIG. 1I shows an elevator with proximity sensing system so that the elevator will slow down and stop when approaching a barrier such as the top or bottom of a elevator shaft.
Figure 1J:
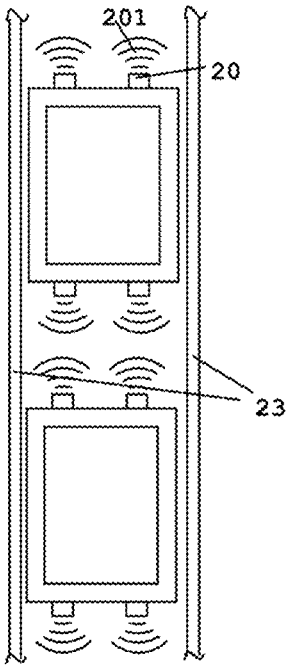
FIG. 1J shows a proximity sensing system for maintaining a safe distance between two elevators in a single elevator shaft.
Figure 2:
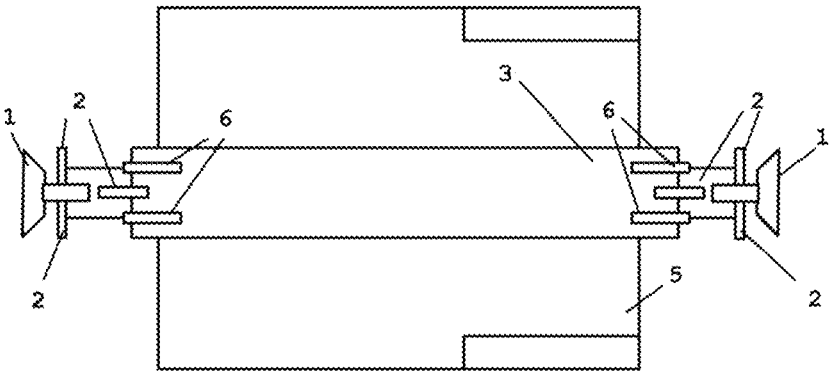
FIG. 2 is the top view of an elevator system of this invention, comprising an elevator cab (5), an elevator main frame (3) with an attachment assembly (4), two parallel guide rails (1), one or more vehicle propulsion systems, each comprising one or more motors (6) and a roller assembly (2), and one or more brake systems at the bottom of said elevator main frame.

In one embodiment, the elevator system of this invention has a proximity sensing system. Currently, all new elevators are equipped with a terminal slowdown system. When an elevator is travelling to the terminal landing, if for any reason the elevator does not slow down, a terminal slowdown limit switch sends signal to a controller to slow down the elevator. The proximity sensing system of this invention can serve as a redundancy system if the terminal limit switch malfunctions. For older elevator systems without a terminal slowdown system, this invention will improve their safety. In one embodiment, an array of proximity sensors (20) connected to the elevator controller is installed at the top and bottom of the elevator. Said proximity sensors determine the distance between the elevator and ceiling (21) or pit floor (22) of the elevator shaft (23) via sensing beams (201) and send this information to the elevator controller e.g. FIG. 1I. If the distance is getting shorter than a preset value, the controller will slow down the elevator. If the distance becomes critically short, the elevator controller will stop the elevator completely. In one embodiment, when said proximity sensing system is installed on elevators in a single elevator shaft, such as in FIG. 1J, said proximity sensing system continuously monitors the distance between the elevator cabs and will send signal to the elevator controllers to maintain a safe distance between the cabs.

In one embodiment, this invention provides a brake system for improving the performance of existing elevator systems. In another embodiment, said brake system is a Smart Brake System comprising a set of rail brakes, an adapted housing unit to fit on different brands of elevators, one or more speed sensors, one or more leveling/door zone sensors, one or more door monitor sensors, one or more integrated CPU, a power module and a battery backup. In one embodiment, said brake system is independent of the elevator controller and does not rely on any elevator controller input or signal to operate. In another embodiment, it can be used on any elevator system to add additional safety features and to bring the system into compliance with any new safety code requirements.

In one embodiment, in comparison to most of the existing systems which require installation of additional floor encoder systems or speed monitor systems, the present system has a built-in speed monitor, so no additional speed monitor system is required. In another embodiment, the elevator speed and the threshold for over-speed can be programmed through the CPU, so that the elevator always runs at a safe speed.

In one embodiment, the present invention further provides methods for increasing the safety of elevators using the brake system of this invention. In one embodiment, when an elevator fitted with the brake system is traveling, the speed sensor will send a signal to a CPU to monitor the speed. In another embodiment, if over-speed occurs, the CPU will send out a fault signal to a power module to close the brakes and stop the elevator safely.

In one embodiment, when the elevator stops at a floor, the leveling/door zone sensors, door monitor sensors and speed sensors will send signals to the CPU which ensures that the elevator floor is level with the floor at which the elevator has stopped. In another embodiment, if any unintended movement occurs, such as when the elevator door is open, the CPU will send out a fault signal to a power module to close the brakes and prevent the elevator from moving.

One of the common problems of traction elevators is rope stretch. When passengers entering or exiting the elevator, due to the weight change, the hoist cable will be stretched or retracted, causing the elevator not to be level with the intended floor, leading to tripping hazard. To eliminate this problem, one embodiment of this invention provides a smart brake system which monitors the elevator condition. In another embodiment, when the elevator is level while the door is open, said smart brake system will be closed to keep the elevator stationary even when passengers are exiting or entering the elevator so as to eliminate any rope stretch and re-leveling.

In one embodiment, the brake system of this invention provides different modes of operation.

In one embodiment, the brake system of this invention provides a controller independent mode, wherein said brake system does not require any input signal from the elevator system. In another embodiment, in normal state under said controller independent mode, the brakes stay open and the system will constantly monitor the speed of the elevator. When an over-speed condition occurs, the brake system will close and stop the elevator safely. In a further embodiment, if the elevator moves past the door zone while the elevator doors are open, the brake system will close and stop the elevator safely.

In one embodiment, the brake system of this invention provides an added protection mode, wherein said brake system requires some input signal from the elevator controller. In another embodiment, under the added protection mode, the brake system provides all the protection under the controller independent mode and additional protection for the elevator. In normal state under said added protection mode, the brakes stay closed and will open when the elevator controller sends the run signal to the brake system so that the brakes will open and allow the elevator to travel. In a further embodiment, when the elevator is stopped, the brake will close and prevent the elevator from further travelling. In yet another embodiment, as the elevator travels, the brake system will constantly monitor the speed of the elevator. If an over-speed condition occurs, the brakes will close and stop the elevator safely. In another embodiment, since the brakes are normally closed, the elevator will not move due to hoist cables stretch when the elevator door opens and passengers go in and out of the elevator, thus eliminating any re-leveling and unintended movement of the elevator.

The Smart Brake System can be directly mounted onto an elevator cab frame. During an emergency, the brake will close and clamp onto the guide rails and stop the elevator directly. The Smart Brake System is an independent system that can be installed on most elevators, new or old.

In one embodiment, in order for the brake system to be fitted onto different types of elevators, different adaptor plates will be selected and mounted on top of the housing unit of the brake system, in order for the brake system to be mounted on different positions of the elevator, e.g. top or bottom of the elevator.

In one embodiment, this invention provides an elevator that can maintain an elevator cab in vertical position while traveling in a non-vertical hoistway. Said elevator system comprises:

1. an elevator main frame (3), comprising an adaptor shaft (41) and two attachment brackets, one on each side of said adaptor shaft (41);
2. an elevator cab frame (19), comprising a main bearing (191) and two attachment brackets (194), one on each side of said main bearing (191); said main bearing has an inner diameter matching the external diameter of said adaptor shaft, said adaptor shaft is fitted into said main bearing to form a pivot between said elevator main frame and said elevator cab frame;
3. two hydraulic pistons, each of said hydraulic pistons having two ends, wherein one of said ends is to be connected to the elevator main frame via attachment bracket (42) and the other end to the elevator cab frame via attachment bracket (194).

In one embodiment, said elevator system further comprises a security plate (43), said adaptor shaft (41) having a slot (44). Said security plate is inserted into said slot after said main bearing is fitted onto said adaptor shaft so as to prevent the main bearing from slipping out. In one embodiment, said elevator cab frame (19) has an elevator platform (193). In one embodiment, said elevator platform (193) is connected to the bottom of an elevator cab (5). In one embodiment, said elevator main frame is connected with a vehicle propulsion system. In one embodiment, said vehicle propulsion system comprises at least one motor. In another embodiment, said vehicle propulsion system is a cable in traction elevator systems. In one embodiment said non-vertical hoistway is a curved hoistway. In one embodiment, said non-vertical hoistway is a looped hoistway.

In one embodiment, this invention provides an elevator that can maintain an elevator cab in vertical position while traveling in a non-vertical hoistway, said elevator system comprises: an elevator main frame, said elevator main frame comprises an alignment motor, a clutch and an alignment motor controller; said alignment motor has a motor shaft; an elevator cab frame, said elevator cab frame comprises a gyro sensor, a motor adaptor plate, said elevator main frame and elevator cab frame are connected via said motor shaft and said motor adaptor plate; said gyro sensor is electrically connected to the alignment motor controller. In one embodiment, said motor shaft comprises a coupling component, said motor adaptor plates comprises bolt holes, bolts firmly secure the elevator cab frame to the elevator main frame via the bolt holes and the coupling component. In one embodiment, said elevator cab frame is connected to an elevator cab. In one embodiment, said elevator cab frame (19) has an elevator platform (193). In one embodiment, said elevator platform (193) is connected to the bottom of an elevator cab (5). In one embodiment, said elevator main frame is connected with a vehicle propulsion system. In one embodiment, said vehicle propulsion system comprises at least one motor. In another embodiment, said vehicle propulsion system is a cable in traction elevator systems. In one embodiment said non-vertical hoistway is a curved hoistway. In one embodiment, said non-vertical hoistway is a looped hoistway.

In one embodiment, the present invention provides an elevator brake system, said elevator brake system comprising:

1. a brake housing, comprising at least one electromechanical brake; said electromechanical brake comprising at least two brake shoes, two electromagnets and two springs, each of said brake shoe is to be connected to one end of said spring; said two brake shows being spaced apart to form a space for placement of a guide rail;
2. a brake control box comprising a controller, said controller controlling power supply to said two electromagnets, so that when power supply to the electromagnets is cut off, said two springs are released and press said brake shoes against said guide rail.

In one embodiment, said brake housing comprises a leveling sensor, said leveling sensor is electrically connected to said controller. In one embodiment, said leveling sensor is for sensing a leveling magnet placed at a level where the elevator is intended to stop. In one embodiment, said brake housing comprises a speed sensor, said speed sensor is electrically connected to the controller. In one embodiment, said brake housing comprises mounting holes for mounting onto an elevator. In one embodiment, said two springs are coil springs. In one embodiment, said brake system is to be mounted on the top or bottom of an elevator. In one embodiment, said elevator is a cableless elevator. In one embodiment, said elevator is a self-propelled elevator.

In one embodiment, this invention provides a power supply system for elevators. Said elevators comprise a vehicle propulsion system. Said power supply system comprises:

1. a power supply strip, comprising an insulator and at least one conductive strip that is connected to a power source;
2. a power receiver (25) that encapsulates said power supply strip and has at least one conductive roller pressing against said at least one conductive strip under the action of a spring; said power receiver being electrically connected to said vehicle propulsion system.

In one embodiment, said insulator is made of a non-conductive material. In one embodiment, said non-conductive material is ceramic or polymer. In one embodiment, said conductive strip is made of a conductive material. In one embodiment, said conductive material is copper. In one embodiment, said conductive roller is made of a conductive material. In one embodiment, said conductive material is copper. In one embodiment, said spring is a coil spring. In one embodiment, said vehicle propulsion system comprises a motor.

In one embodiment, this invention provides a cableless elevator system, wherein more than one elevator can be used in a single hoistway. Said elevator system comprises:

1. at least one elevator and a pair of parallel guide rails; said elevator comprising an elevator cab; an elevator main frame connected to said elevator cab, said elevator main frame comprising at least one motor and a set of rollers driven by said motor; said set of rollers clamping on said pair of parallel guide rails and comprising at least two drive wheels or rollers for travelling along said pair of parallel guide rails;
2. a proximity detection system, comprising proximity sensors on the top and bottom of said elevator cab;
3. a motor controller electrically connected with said proximity detection system and said motor, said motor controller for preventing an elevator from hitting any obstacles.

In one embodiment, said at least two drive wheels or rollers are made of a durable elastic material, or rubber reinforced with steel wires. In one embodiment, said at least two drive wheels or rollers are gears that are complementary to the teeth on the guide rails. In one embodiment, said elevator main frame comprises at least two motors that are synchronized. In one embodiment, said elevator main frame is connected to one side of said elevator cab. In one embodiment, said main frame is connected to the center of said elevator cab. In one embodiment, each of said at least two motors has a tachometer that is electrically connected to said motor controller. In one embodiment, each of said at least two motors has an encoder which measures the speed of the motor and is electrically connected to said motor controller. In one embodiment, said elevator cab is connected to said elevator main frame by a pivot joint.

Those skilled in the art will readily appreciate that the specific details described herein are only for illustrative purpose, and are not meant to limit the scope of the invention, which is defined by the claims which follow thereafter.

What is claimed is:

1. An elevator system comprising:

(a) An elevator cab;

(b) Two parallel guide rails engaged with said elevator cab;

(c) An elevator main frame connected to said elevator cab, wherein said elevator main frame comprises at least one vehicle propulsion system comprising a power supply system and one or more motors coupled to a roller assembly, wherein said roller assembly is powered by said motors to move the elevator cab along said guide rails; and (d) One or more brake systems, each comprising (1) a brake housing, said brake housing comprising at least one electromechanical brake; said electromechanical brake comprising at least two brake shoes, two electromagnets and two springs, each of said brake shoe being connected to one end of said spring; said two brake shoes being spaced apart to form a space for placement of one of said two parallel guide rails; (2) a brake control box, said brake control box comprising a controller, said controller controlling power supply to said two electromagnets, wherein when power supply to the electromagnets is cut off, said two springs are released and press said brake shoes against said guide rail.

2. The elevator system of claim 1, wherein said one or more motors are synchronized.

3. The elevator system of claim 2, wherein said two springs are coil springs.

4. The elevator system of claim 2, wherein said brake system is to be mounted on the top or bottom of said elevator cab.

5. The elevator system of claim 2 wherein said power supply system comprises a power supply strip comprising an insulator and one or more conductive strips;

wherein said power supply strip runs along said one or two parallel guide rails and is connected to a power source.

6. The elevator system of claim 2 wherein said power supply system comprises one or more pantograph-like devices electrically connected to a power source.

7. The elevator system of claim 2 wherein the elevator cab further comprises a conducting device electrically connected to said one or more guide rails, wherein said one or more guide rails is connected to a power source.

8. The elevator system of claim 2 wherein said elevator system further comprises a cab frame comprising a gyro sensor configured to monitor the orientation of the elevator cab.

9. The elevator system of claim 8, wherein said elevator main frame further comprises an alignment motor, a clutch operationally connected to the alignment motor and an alignment motor controller, wherein said gyro sensor is electrically connected to the alignment motor controller, wherein said gyro sensor is configured to send signals to said alignment motor controller when the elevator cab is not in a vertical position, wherein said alignment motor controller is configured to cause the elevator cab to return to the vertical position upon receiving said signals.

10. An elevator brake system comprising (1) a brake housing comprising at least one electromechanical brake; said electromechanical brake comprising at least two brake shoes, two electromagnets and two springs, each of said brake shoe being connected to one end of said spring; said two brake shoes being spaced apart to form a space for placement of a guide rail (2) a brake control box comprising a controller, said controller controlling power supply to said two electromagnets, wherein when power supply to the electromagnets is cut off, said two springs are released and press said brake shoes against said guide rail.

11. The elevator brake system of claim 10, wherein said brake housing further comprises mounting holes for mounting onto an elevator.

12. The elevator brake system of claim 10, wherein said two springs are coil springs.

13. The elevator brake system of claim 10, wherein said brake system is to be mounted on the top or bottom of an elevator.

* * * * *